US005588804A

United States Patent [19]

Neely et al.

[11] Patent Number: 5,588,804

[45] Date of Patent: Dec. 31, 1996

[54] HIGH-LIFT AIRFOIL WITH BULBOUS LEADING EDGE

[75] Inventors: Michael J. Neely, Dayton; John R. Savage, Kettering, both of Ohio

[73] Assignee: ITT Automotive Electrical Systems, Inc., Auburn Hills, Mich.

[21] Appl. No.: 342,358

[22] Filed: Nov. 18, 1994

[51] Int. Cl.[6] ..... F01D 5/14

[52] U.S. Cl. ..... 416/223 R; 416/242

[58] Field of Search ..... 416/223 R, 223 A, 416/242

[56] References Cited

U.S. PATENT DOCUMENTS

| | | | |
|---|---|---|---|
| 1,903,823 | 4/1933 | Lougheed | 416/223 R |
| 2,157,999 | 5/1939 | Charavay | 416/242 |
| 2,682,925 | 7/1954 | Wosika | 416/223 A |
| 3,333,817 | 8/1967 | Rhomberg | 416/242 |
| 3,565,548 | 2/1971 | Fowler et al. | 416/223 A |
| 4,073,601 | 2/1978 | Kress | 416/242 |
| 4,135,858 | 1/1979 | Entat . | |
| 4,358,245 | 11/1982 | Gray . | |
| 4,569,631 | 2/1986 | Gray, III . | |
| 4,569,632 | 2/1986 | Gray, III . | |
| 4,684,324 | 8/1987 | Perosino . | |
| 4,685,513 | 8/1987 | Longhouse et al. . | |
| 4,840,541 | 6/1989 | Sakane et al. . | |
| 4,871,298 | 10/1989 | Vera . | |
| 4,900,229 | 2/1990 | Brackett et al. . | |
| 4,915,588 | 4/1990 | Brackett . | |
| 4,930,984 | 6/1990 | Kesel et al. . | |
| 4,971,520 | 11/1990 | Van Houten . | |
| 5,000,660 | 3/1991 | Van Houten et al. . | |
| 5,064,345 | 11/1991 | Kimball . | |
| 5,169,290 | 12/1992 | Chou . | |
| 5,193,981 | 3/1993 | Scheidel et al. . | |
| 5,197,854 | 3/1993 | Jordan . | |
| 5,221,187 | 6/1993 | Lorea et al. . | |
| 5,244,347 | 9/1993 | Gallivan et al. . | |
| 5,320,493 | 6/1994 | Shih et al. . | |
| 5,326,225 | 7/1994 | Gallivan et al. . | |
| 5,342,167 | 8/1994 | Rosseau . | |
| 5,354,178 | 10/1994 | Ferleger et al. | 416/242 |
| 5,390,070 | 3/1995 | Alizaden . | |
| 5,393,199 | 2/1995 | Alizadeh . | |

FOREIGN PATENT DOCUMENTS

| | | | |
|---|---|---|---|
| 410800 | 9/1923 | Germany . | |
| 3640780 | 10/1988 | Germany . | |
| 4326147 | 11/1994 | Germany . | |
| 0000583 | 1/1971 | Japan | 416/223 A |
| 1290128 | 2/1971 | U.S.S.R. | 416/242 |

OTHER PUBLICATIONS

International Search Report dated Apr. 25, 1996.

*Primary Examiner*—Edward K. Look
*Assistant Examiner*—Mark Sgantzos
*Attorney, Agent, or Firm*—Thomas N. Twomey; J. Gordon Lewis

[57] ABSTRACT

An airfoil defining the shape of the blades of a vehicle engine-cooling fan assembly. The airfoil has a leading edge; a rounded, bulbous nose section adjacent the leading edge; a trailing edge; a curved pressure surface extending smoothly and without discontinuity from the nose section to the trailing edge; a curved suction surface extending smoothly and without discontinuity from the nose section to the trailing edge; and a thin aft section formed adjacent the trailing edge and between the pressure surface and the suction surface. The aft section has a camber at its location of maximum camber of between 5 and 12% of the chord of the airfoil. The nose section has a thickness which is greater than the thickness of the airfoil between the pressure surface and the suction surface, blends smoothly into the suction surface, and blends smoothly into the pressure surface via a first blend radius forming a convex surface extending from the nose section adjacent the leading edge and a second blend radius forming a concave surface extending from the convex surface to the pressure surface of the airfoil.

17 Claims, 10 Drawing Sheets

HIGH-LIFT AIRFOIL WITH BULBOUS LEADING EDGE

FIELD OF THE INVENTION

This invention relates generally to a high-lift airfoil for use in a vehicle engine-cooling fan assembly and, more particularly, to such an airfoil having a bulbous nose adjacent its leading edge which smoothly merges into both the pressure and suction surfaces of the airfoil.

BACKGROUND OF THE INVENTION

A multibladed cooling air fan assembly 10 (which incorporates the present invention) is shown in FIG. 1. Designed for use in a land vehicle, fan assembly 10 induces air flow through a radiator to cool the engine. Fan assembly 10 has a hub 12 and an outer, rotating ring 14 that prevents the passage of recirculating flow from the outlet to the inlet side of the fan. A plurality of blades or airfoils 100 (seven are shown in FIG. 1) extend radially from hub 12 to ring 14.

To improve the operation of fan assembly 10, much attention has focused on the design or shape of the airfoils. High lift and efficiency are required to meet the ever-increasing operational standards for vehicle engine-cooling fan assemblies. There are many different airfoil shapes and slight variations in shape alter the characteristics of the airfoil in one way or another.

Because only slight variations in airfoil design yield large differences in aerodynamic performance, a multitude of different airfoils were developed by approximately 1920. At that time, there was no orderly system of identifying the different airfoils. Those that seemed to prove effective were simply given arbitrary designations such as RAF 6, Gottingen G-398, and Clark Y.

The National Advisory Committee for Aeronautics (NACA), which was the forerunner of NASA, developed an identification system in the late 1920s. NACA's wind tunnel tests showed that the aerodynamic characteristics of airfoils depend primarily upon two shape variables: the thickness form and the mean-line form. NACA then proceeded to identify these characteristics in a numbering system for the airfoils.

The first such airfoils are referred to by the NACA four-digit series. The NACA 2412 airfoil is a typical example. The first number (2 in this case) is the maximum camber in percent (or hundredths) of chord length. The second number, 4, represents the location of the maximum camber point in tenths of chord and the last two numbers, 12, identify the maximum thickness in percent of chord. All characteristics are based on chord length (c) because they are all proportional to the chord. For this airfoil, the maximum camber is 0.02c, the location of maximum camber is 0.4c, and the maximum thickness is 0.12c.

The flat plate 20, shown in FIG. 2*a* in an air stream 18, is the simplest of airfoils. At zero angle of attack ($\alpha$), flat plate 20 produces no lift because it is actually a symmetrical airfoil (it has no camber). At a slightly positive angle of attack, however, flat plate 20 will produce lift, as shown in FIG. 2*b*. Flat plate 20 is not a very efficient airfoil because it creates a fair amount of drag. The sharp leading edge 22 also promotes stall at a very small angle of attack and, therefore, severely limits the lift-producing ability of flat plate 20. The stall condition is illustrated in FIG. 2*c*.

For these reasons, airfoils were provided with a curved nose adjacent the leading edge. That modification enables the airfoil to achieve higher angles of attack without stalling.

Such an airfoil is efficient, however, only over a small range of angles. Accordingly, the curved nose was filled in so that a wider range of angles of attack was possible. These thicker airfoils displayed greater lifting capability and finally evolved into the shape shown in FIGS. 3*a* and 3*b*, recognized as the "typical" or "classic" thicker airfoil 30.

FIG. 3*a* illustrates the conventional thicker airfoil 30 having a leading edge 32, a trailing edge 34, and substantially parallel surfaces 36 and 38. The chord of thicker airfoil 30 is the straight line (represented by the dimension "c") extending directly across the airfoil from leading edge 32 to trailing edge 34. The camber is the arching curve (represented by the dimension "a") extending along the center or mean line 40 of thicker airfoil 30 from leading edge 32 to trailing edge 34. Camber is measured from a line extending between the leading and trailing edges of the airfoil (i.e., the chord length) and mean line 40 of thicker airfoil 30.

As shown in FIG. 3*b*, when thicker airfoil 30 contacts a stream of air 18, the air stream engages leading edge 32 and separates into streams 42 and 44. Stream 42 passes along surface 36 while stream 44 passes along surface 38. As is well known, stream 42 travels a greater distance than stream 44, at a higher velocity, with the result that air adjacent to surface 36 is at a lower pressure than air adjacent to surface 38. Consequently, surface 36 is called the "suction side" of thicker airfoil 30 and surface 38 is called the "pressure side" of thicker airfoil 30. The pressure differential creates lift.

Airfoils with the classic profile of thicker airfoil 30 illustrated in FIGS. 3*a* and 3*b* have been used in engine-cooling fan assemblies. Such airfoils improved fan efficiency relative to contemporary, competing airfoil profiles. They have been unable, however, to provide the higher lift-to-drag ratios now desired for automotive applications. High lift and increased efficiency are needed to meet higher operational standards for vehicle engine-cooling fan assemblies. Accordingly, additional airfoil designs have been developed.

U.S. Pat. No. 5,151,014, assigned to Airflow Research and Manufacturing Corporation (ARMC), discloses an airfoil having a reduced, substantially constant thickness over most of its chord length. Accordingly, the ARMC airfoil 50 (see FIGS. 4*a*, 4*b*, and 4*c* which correspond to FIGS. 2*a*, 2*b*, and 3, respectively, in the '014 patent) is lighter than thicker airfoil 30 and, ostensibly, offers increased efficiency. ARMC airfoil 50 has a leading edge 52, a trailing edge 54, and substantially parallel suction surface 56 and pressure surface 58.

Pressure surface 58 has a first sharp corner 60, such that pressure surface 58 diverges or bends towards suction surface 56, thereby creating a thick nose section 62 and a reduced thickness portion 64. The distance between corner 60 and leading edge 52 is between 5% and 10% of the chord length of ARMC airfoil 50. Pressure surface 58 also has a second sharp corner 61 upon termination of straight line portion 59 of pressure surface 58. The dashed line 66 in FIGS. 4*a* and 4*b* illustrates the pressure surface of thicker airfoil 30.

FIG. 4*b* illustrates the flow of air over ARMC airfoil 50. A stream of air 18 intersects ARMC airfoil 50 at leading edge 52 and separates into streams 68 and 70. Stream 68 flows along suction surface 56. Stream 70 may not flow, however, along pressure surface 58. According to the '014 patent, stream 70 will separate from pressure surface 58 at corner 60 and will follow a path similar to the path followed by stream 44 for thicker airfoil 30 shown in FIG. 3*b*. Therefore, ARMC airfoil 50 appears to have substantially the same flow characteristics as thicker airfoil 30.

To assure that stream 70 separates from pressure surface 58, the angle at which pressure surface 58 diverges at corner 60 must be greater than a threshold angle. If the bend is too gradual, stream 70 will turn at corner 60 and remain close to pressure surface 58—resulting in increased loading and noise. Referring to FIG. 4*c*, corner 60 bends at an angle θ of at least 30°. Angle θ is measured between lines tangent to pressure surface 58 on each side of corner 60. Although the air flow disclosed in the ÷014 patent may occur, it is unnecessary for the design of a high-lift, lightweight airfoil.

U.S. Pat. No. 4,692,098, assigned initially to General Motors Corporation, discloses an airfoil shaped for improved pressure recovery. In this design, a discontinuity in the form of a flat, step, scribe mark, cavity, or surface roughness is made on the suction surface 86—rather than on the pressure surface 88—of the discontinuous airfoil 80 of the '098 patent (see FIG. 5 which corresponds to FIG. 4 in the '098 patent). Preferably, a flat 82 transverse to the chord of discontinuous airfoil 80 and adjacent to the airfoil nose 84 is provided on suction surface 86. Flat 82 extends rearward from a sharp edge 94 that is located toward the forward end of the laminar boundary layer region. Flat 82 forms a ramp that makes a 9° angle with a tangent line 96 to the upstream suction surface 86 of discontinuous airfoil 80. Discontinuous airfoil 80 also has a rounded leading edge 90, a trailing edge 92, and a so-called Stratford recovery region that connects flat 82 to trailing edge 92.

Discontinuous airfoil 80 is designed to control the size and location of the laminar separation bubble that forms on suction surface 86 as the airfoil operates in a low-Reynolds-number environment. Airfoils of this type are very effective at reducing the size of the laminar separation bubble and ensuring the re-attachment of flow on suction surface 86. By controlling the separation and re-attachment in this manner, discontinuous airfoil 80 operates at a high lift-to-drag ratio.

Airfoils like discontinuous airfoil 80 have been used for many years in engine-cooling fan assemblies on General Motors vehicles. On an airfoil with a straight planform, a discontinuous airfoil 80 with a flat 82 provides excellent performance across a wide operating range. On the new, backward-curved blades used (for example) in the air conditioning systems without chlorinated fluorocarbons (CFCs), however, discontinuous airfoil 80 is not as effective as an airfoil with a smooth, continuous suction surface.

To overcome the shortcomings of conventional airfoils, including ARMC airfoil 50 and discontinuous airfoil 80, a new airfoil 100 is provided. An object of the present invention is to provide an improved, light-weight airfoil with high lift. Another object is to provide an airfoil having both a smooth, continuous suction surface and a smooth, continuous pressure surface—neither surface having a discontinuity. Still another object is to provide an airfoil that turns an airflow using a highly cambered, thin aft section, while delaying flow separation using a bulbous nose adjacent the leading edge. The required turning is achieved, according to another object of the present invention, with lower mass and higher aerodynamic efficiency than comparable airfoils. An additional object is to provide an improved airfoil that avoids stall at a large range of attack angles; minimizes drag (and, consequently, has a high lift-to-drag ratio); and reduces loading and noise.

A related object is to improve the operational and air-pumping efficiencies of an engine-cooling fan assembly having a plurality of airfoils. Airfoils produce turning of the air stream through the assembly, thereby creating a pressure rise across the assembly. Yet another object of the present invention is to provide an airfoil in an engine-cooling fan assembly that provides high pressure rise across the fan assembly and reduced mass. It is still another object of the present invention to reduce the axial depth of the ring of the assembly. Finally, it is an object of the present invention to provide an airfoil design suitable for the entire range of engine-cooling fan assembly operation, including idle.

SUMMARY OF THE INVENTION

To achieve these and other objects, and in view of its purposes, the present invention provides an airfoil defining the shape of the blades of a vehicle engine-cooling fan assembly. The airfoil has a leading edge; a rounded, bulbous nose section adjacent the leading edge; a trailing edge; a curved pressure surface extending smoothly and without discontinuity from the nose section to the trailing edge; a curved suction surface extending smoothly and without discontinuity from the nose section to the trailing edge; and a thin aft section formed adjacent the trailing edge and between the pressure surface and the suction surface. The aft section has a camber at its point of maximum camber of between 5 and 12% of the chord of the airfoil. The nose section has a thickness which is greater than the thickness of the airfoil between the pressure surface and the suction surface (i.e., about twice as thick as the aft section), blends smoothly into the suction surface, and blends smoothly into the pressure surface via a first blend radius forming a convex surface extending from the nose section adjacent the leading edge and a second blend radius forming a concave surface extending from the convex surface to the pressure surface of the airfoil.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
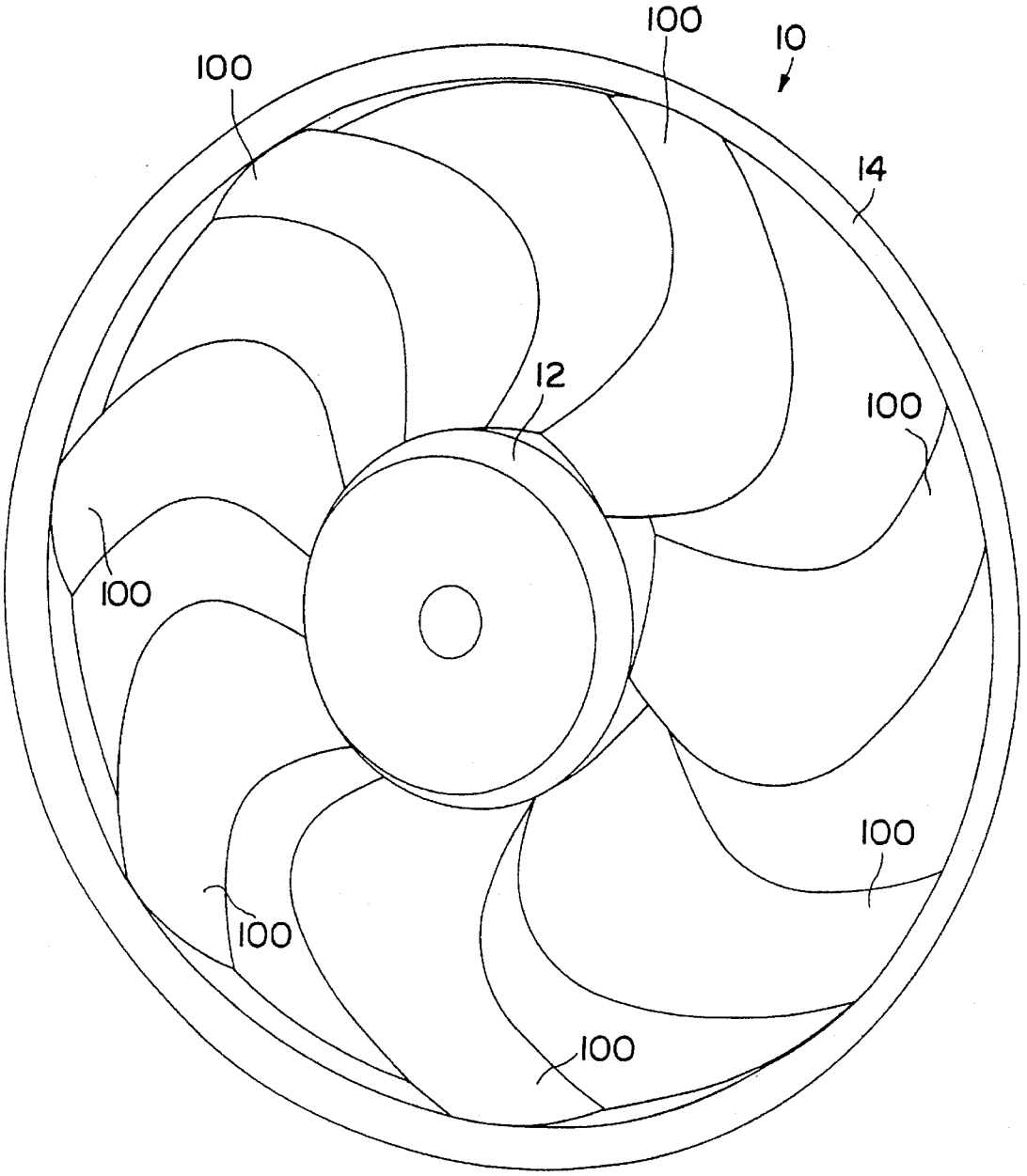
FIG. 1 is a front elevational view of a multibladed cooling air fan assembly incorporating the airfoil of the present invention.
Figure 2A:
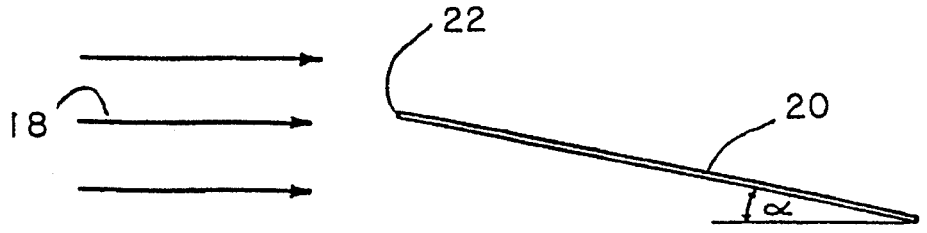
FIG. 2a (PRIOR ART)
FIG. 2*a* illustrates a conventional flat plate airfoil in an airstream.
Figure 2B:
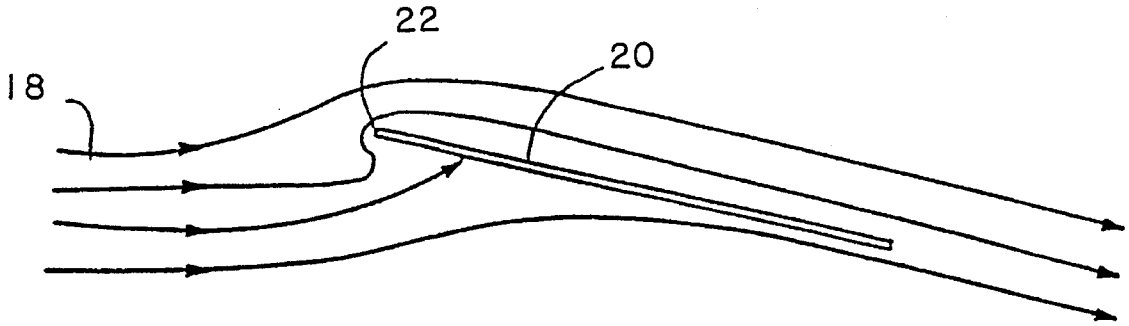
FIG. 2b (PRIOR ART)
FIG. 2*b* is the flat plate airfoil illustrated in FIG. 2*a* showing the airstream at a slight angle of attack.
Figure 2C:
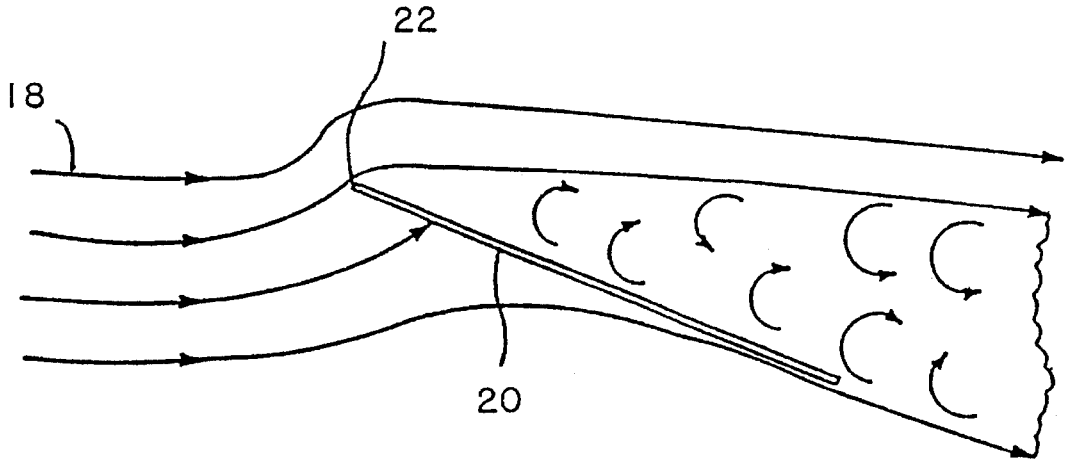
FIG. 2c (PRIOR ART)
FIG. 2*c* is the flat plate airfoil illustrated in FIG. 2*a* during a stalled condition.
Figure 6:
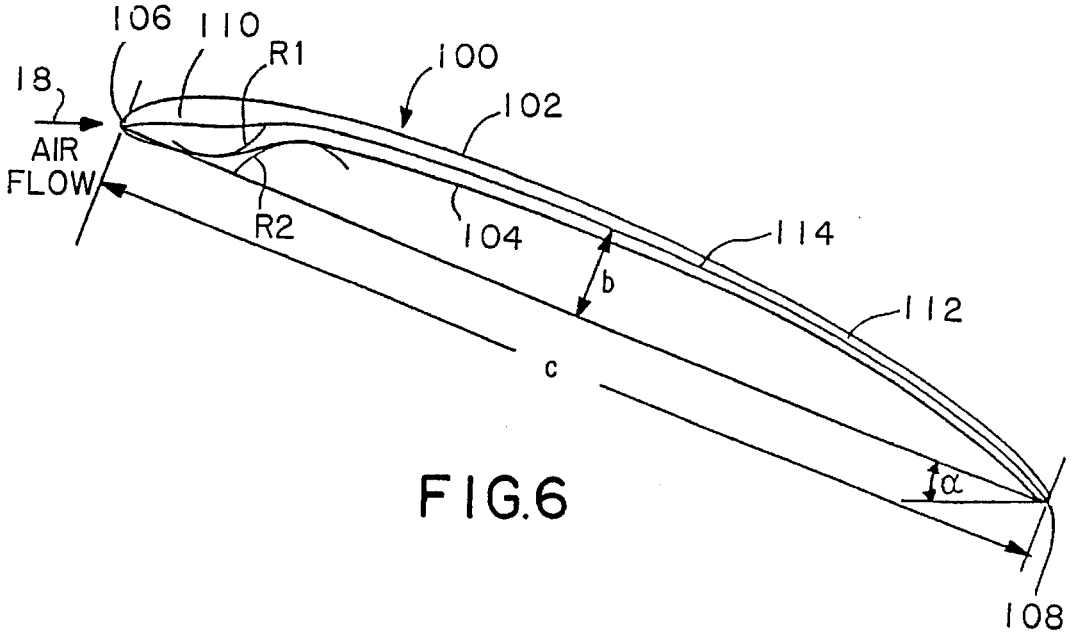
FIG. 6 is a cross-sectional view of the airfoil of the present invention.

Referring now to the drawing, FIG. 6 shows airfoil 100 according to the present invention. Airfoil 100 is used in an engine-cooling fan blade assembly 10 (see FIG. 1). It is emphasized that, according to common practice, the various features of the drawing are not to scale. On the contrary, the width or length and thickness of the various features are arbitrarily expanded or reduced for clarity.

Airfoil 100 has a suction surface 102 and a pressure surface 104 which meet at the leading edge 106 and the trailing edge 108. A rounded, thick, bulbous nose section 110 merges smoothly with the thin, highly-cambered aft section 112 on both suction surface 102 and pressure surface 104. There are no discontinuities or abrupt changes on either suction surface 102 or pressure surface 104.

Airfoil 100 presents an angle of attack ($\alpha$) with air stream 18. Rounded, thick, bulbous nose section 110 prevents separation as the air traverses airfoil 100 from leading edge 106 to trailing edge 108. The camber of airfoil 100 is the arching curve (represented by the dimension "b") extending along the center or mean line 114 from leading edge 106 to trailing edge 108. Thin aft section 112 provides high camber and, consequently, high lift. The camber at the location of maximum camber of aft section 112 is between 5 and 12% of the chord.

Figure 3A:
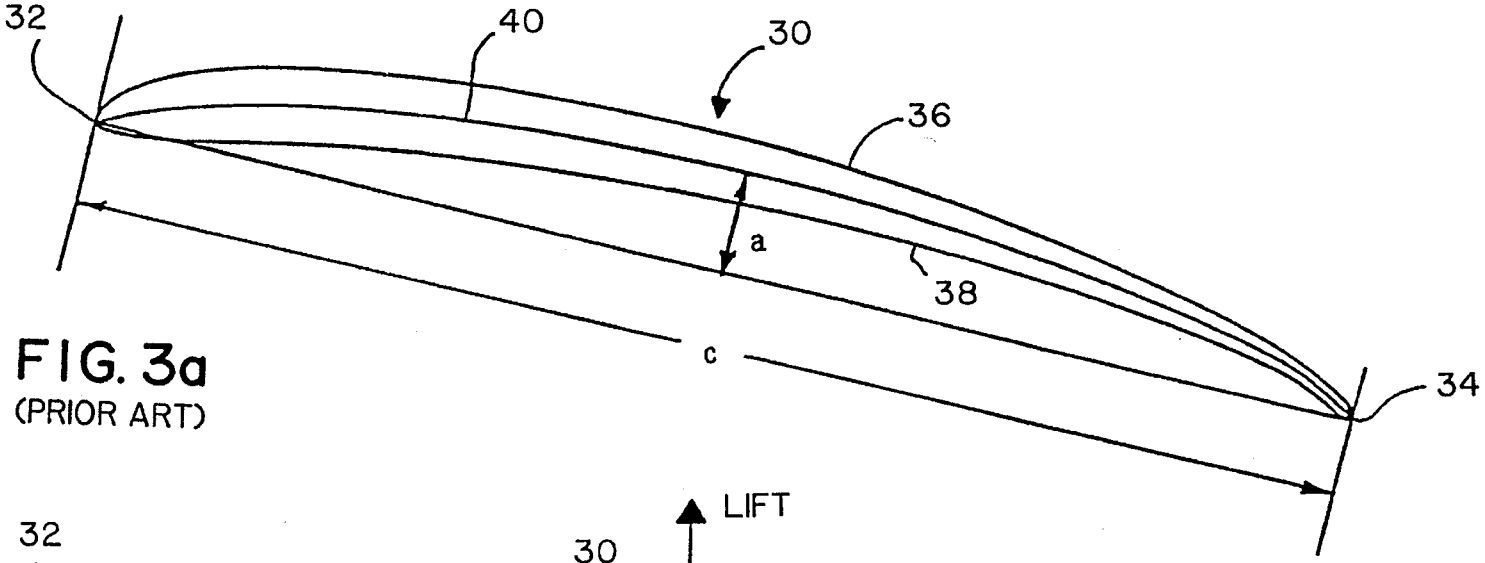
FIG. 3a (PRIOR ART)
FIG. 3*a* is a cross-sectional view of a conventional thicker airfoil.
Figure 3B:
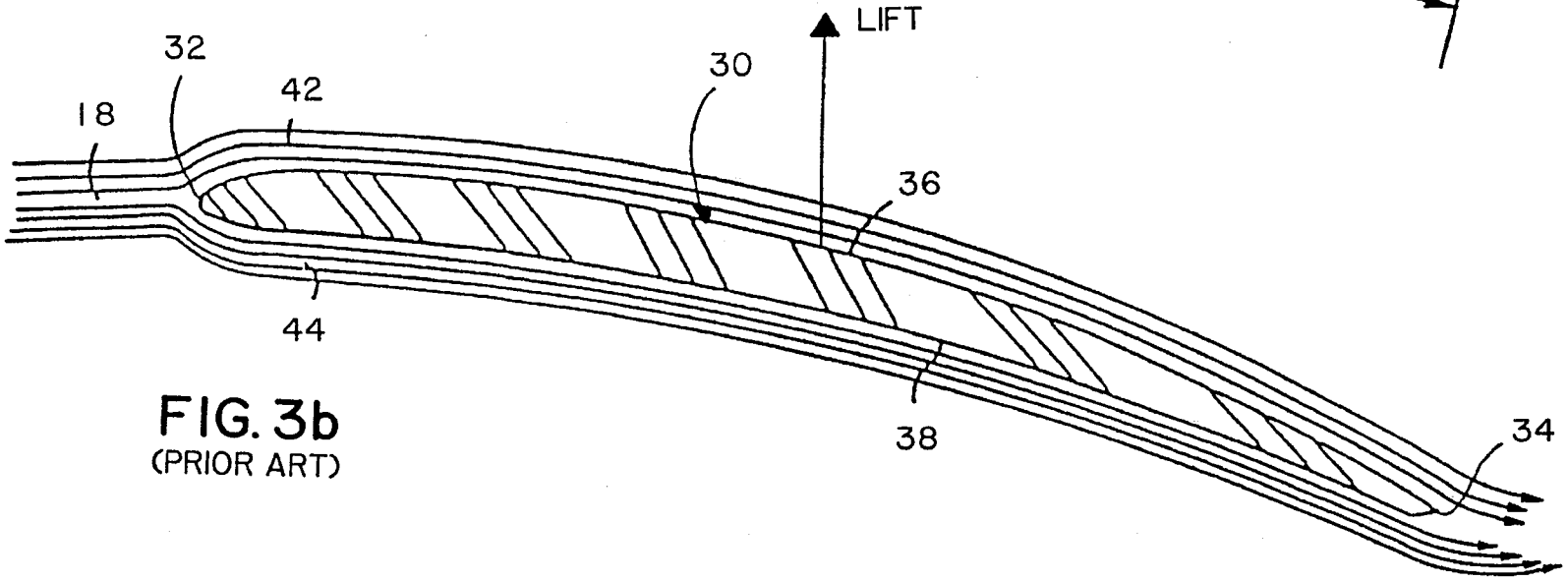
FIG. 3b (PRIOR ART)
FIG. 3*b* illustrates the conventional thicker airfoil, shown in FIG. 3*a*, in an airstream.
Figure 7:
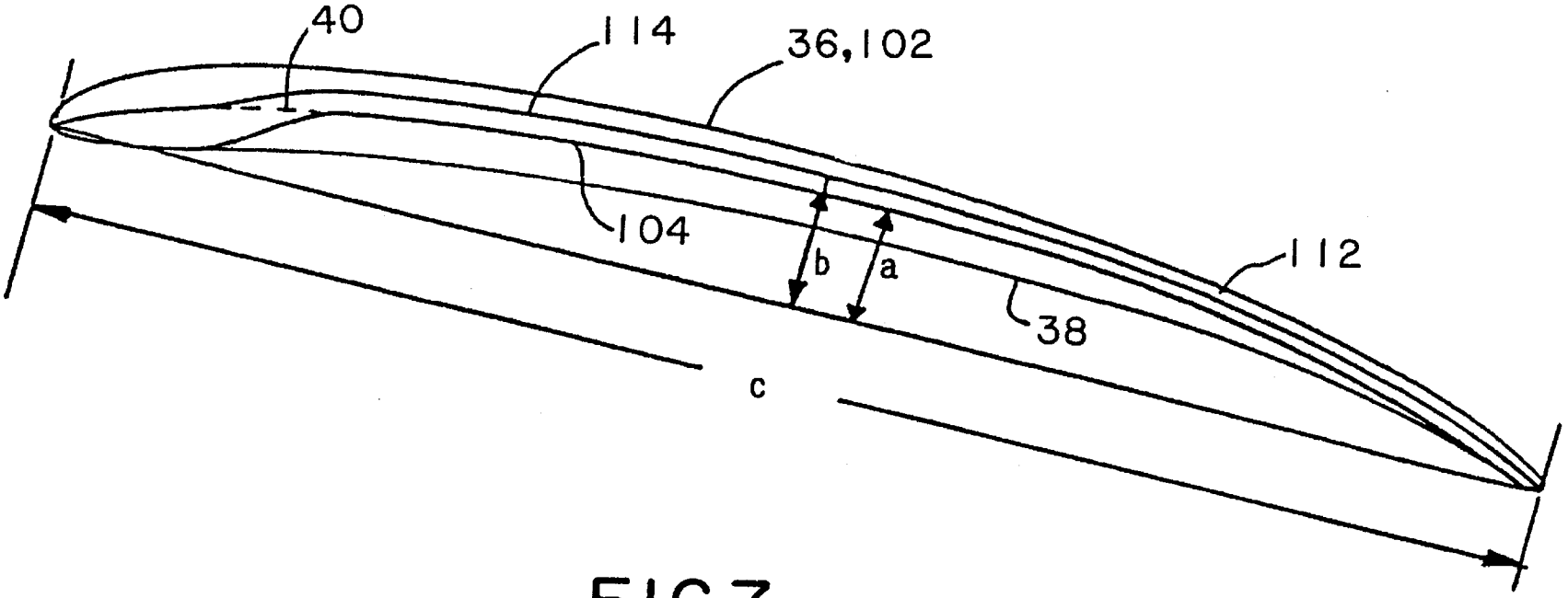
FIG. 7 is a comparison between the thicker airfoil shown in FIG. 3*a* and the airfoil of the present invention shown in FIG. 6.

As shown in FIG. 7, which presents a comparison between thicker airfoil 30 of FIG. 3*a* and airfoil 100 of FIG. 6 (via an overlay of airfoil 100 on thicker airfoil 30), material is removed from pressure surface 104 of airfoil 100 relative to thicker airfoil 30. Such material removal shifts the mean line of the airfoil upward (compare mean line 40 of thicker airfoil 30 with mean line 114 of airfoil 100) and increases the camber (b>a). Mean line 40 of thicker airfoil 30 is confluent with pressure surface 104 of airfoil 100 along most of its length; therefore, thin aft section 112 is about half as thick as the aft section of thicker airfoil 30. Suction surface 36 of thicker airfoil 30 and suction surface 102 of airfoil 100 coincide.

A quantitative analysis of the comparison illustrated in FIG. 7 was performed. For blades with a chord of approximately 75 mm, the camber at mid-span of thicker airfoil 30 is about 5.7 mm (or 7.7% of chord) while the camber at mid-span of airfoil 100 is about 6.7 mm (or 8.9% of chord). Thus, b (=6.7 mm) is about 15% larger than a (=5.7 mm) in this example.

The "smooth merging" of rounded, thick, bulbous nose section 110 into pressure surface 104 is achieved, for the embodiment of the invention disclosed, by two blend radii, R1 and R2 (see FIG. 6). R1 forms a convex surface extending from nose section 110 adjacent leading edge 106 of airfoil 100 and R2 forms a concave surface extending from the convex surface to the remaining pressure surface 104 of airfoil 100. Large blend radii R1 and R2 assure that the air flow remains attached over the entire pressure surface 104. It is very important that the flow remain attached, to both suction surface 102 and pressure surface 104, to achieve high lift with low noise and low drag. Preferably, R1 and R2 are approximately equal and are no less than about 8% of the chord, c.

For the example airfoil 100 discussed above, having a chord of about 75 mm, R1 and R2 are both slightly less than 10% of chord (R1=7.3 mm or 9.7% of chord; R2=7.2 mm or 9.6% of chord). Rounded, thick, bulbous nose section 110 in that example is about twice as thick as thin aft section 112.

The design combination of rounded, thick, bulbous nose section 110 (which prevents flow separation); smooth merging of nose section 110 into both suction surface 102 and pressure surface 104 (which assures that the air flow remains attached over the entire suction surface 102 and pressure surface 104); and thin aft section 112 (which provides high camber and, consequently, high lift) gives airfoil 100 a uniquely efficient profile.

The reduced thickness of airfoil 100 with respect to thicker airfoil 30 (FIG. 7) results, of course, in an airfoil with lower mass. On an experimental blade with airfoil 100 having the profile described above, blade mass was reduced by about 35% relative to a comparable, thicker blade with airfoil 30. Specifically, the blade with airfoil 100 has a mass of about 19.7 grams while the blade with thicker airfoil 30 has a mass of about 31.9 grams. The reduced mass of the blade with airfoil 100 results, in turn, in a fan assembly 10 with lower mass.

Figure 8:
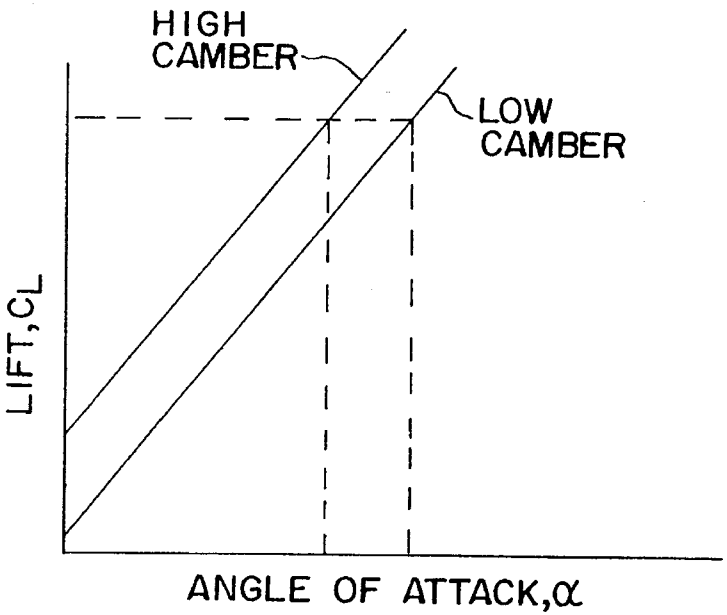
FIG. 8 is a graph of Coefficient of Lift ($C_L$) versus Angle of Attack ($\alpha$) for an airfoil with higher and lower camber.

As discussed above, airfoil 100 provides higher camber and increased lift verses comparable thick airfoil 30. High-lift airfoil 100 can be pitched at a lower angle of attack, therefore, to provide the same lift as thicker airfoil 30. This is illustrated by FIG. 8, which is a graph of Coefficient of Lift ($C_L$) versus Angle of Attack ($\alpha$) for an airfoil with higher and lower camber. The efficiency of the airfoil then increases as the angle of attack decreases.

Figure 9B:
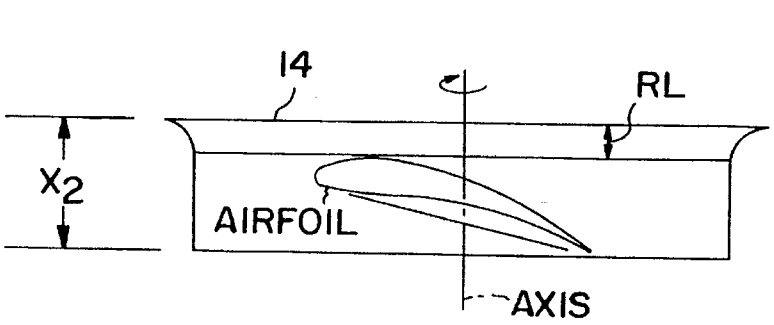
FIG. 9*b* shows the axial depth of the ring of the fan assembly of FIG. 1 when the airfoil has a low angle of attack.
Figure 9A:
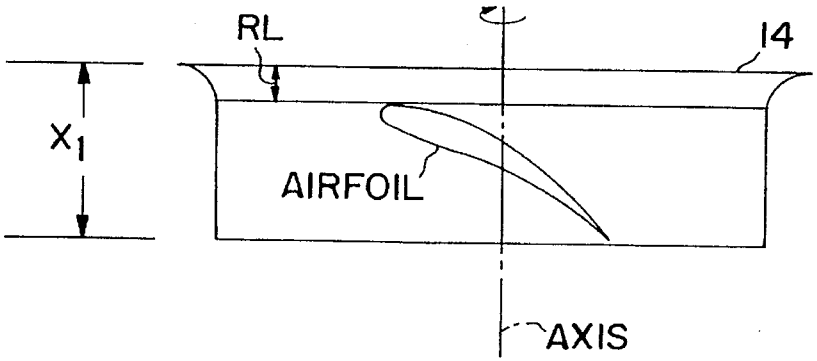
FIG. 9*a* shows the axial depth of the ring of the fan assembly of FIG. 1 when the airfoil has a high angle of attack.

Thus, the improvement in lift provided by airfoil 100 allows reduction in the attack angle. Reduction of the attack angle permits reduction of the axial depth of ring 14 of fan assembly 10. This advantage is illustrated in FIGS. 9*a* and 9*b* (both figures depict ring 14 rotating clockwise, when ring 14 is viewed from above, around its central axis). FIG. 9*a* shows the axial depth, $x_1$, of ring 14 when the airfoil has a high angle of attack. FIG. 9*b* shows the axial depth, $x_2$, of ring 14 when the airfoil has a lower angle of attack. Clearly, $x_2$ is less than $x_1$. RL is the radius of the ring inlet.

Turning to a specific example, the axial depth of ring 14 when the airfoil has a pitch of about 15.5° is $x_1$=25.4 mm.

The axial depth of ring 14 when the airfoil has a pitch of about 13.5° is $x_2$=23.4 mm. Thus, a reduction in axial depth of $x_1-x_2$=2 mm (or about 8%) is achieved. Ring axial depth is calculated as RL+Chord×sin(airfoil pitch angle). The radius of the ring inlet, RL, is about 10 mm in this specific example.

With airfoil 100 pitched to provide performance equal to the performance of thick airfoil 30 (i.e., at a decreased angle of attack), the reduced axial depth of ring 14 resulted in a decrease of 9% in the mass of ring 14. For the example discussed above, the mass of ring 14 was reduced by about 7.3 grams (from about 81 grams to about 74 grams). The lower axial depth of ring 14 results, therefore, in a further reduction in the mass of fan assembly 10 in addition to the reduced mass of the blades with airfoils 100. The total reduction in the mass of fan assembly 10 for the current example is about 92.7 grams, calculated as the sum of the 7.3 grams reduction in the ring mass plus an 85.4 grams reduction (12.2 grams×7 blades=85.4 grams) in the blade mass.

Consequently, fan assembly 10 has a reduced moment of inertia and it is easier to balance fan assembly 10. The reduced mass of fan assembly 10 also contributes to lower vehicle mass and reduces material costs. Vehicle packaging is also improved because clearances from fan assembly 10 to adjacent engine components or to the heat exchanger are increased in the axial direction.

Although it must have a hub 12, fan assembly 10 need not have a ring 14. The advantageous reduction in the mass of ring 14 provided by airfoil 100 would be inapplicable, of course, to fan assembly 10 without ring 14. Nevertheless, airfoil 100 would give ringless fan assembly 10 other advantages (such as packaging) because airfoil 100 enables a reduced-depth blade (the blade can be set at a lower angle of attack which allows the blade to occupy less axial depth).

A prototype blade using airfoil 100 was built and tested in a fan assembly 10. Thicker airfoil 30, configured relative to airfoil 100 as shown in FIG. 7 (e.g., having an identical suction surface), was also tested in a similar fan assembly 10. Fan assembly 10 included a hub 12 with a diameter of 130 mm, seven blades (having either airfoils 100 or thicker airfoils 30), and a rotating ring 14 with a 340 mm inside (tip) diameter. The airflow performance test results showed a high pressure rise with little change in efficiency for airfoil 100 as compared to thicker airfoil 30.

The operating point of fan assembly 10 is the combination of airflow through the fan assembly and the pressure rise across the fan assembly; it is essentially the ratio of pressure to airflow including additional factors to provide non-dimensionalization. Higher value operating points indicate higher pressure rise and lower airflow operation. Lower values indicate higher airflow rates through, and lower pressure rise across, fan assembly 10.

The non-dimensional operating range for typical automotive engine-cooling fan assemblies includes values between about 0.7 to 1.5. Idle operation is the most important point for fan assembly performance. Typical idle operating points range from 1.3 to 1.5. Thus, this range of fan assembly operation is most important for performance evaluation of the fan assembly.

The "pumping" performance of fan assembly 10 is defined as the speed that fan assembly 10 must turn to deliver a given airflow performance. Pumping, or the flow to speed ratio, changes as a function of pressure rise and flow operation point of fan assembly 10. It is desirable to have a fan assembly 10 with both high pumping and high operation efficiency (eta, $\eta$). Comparisons of performance between fan assemblies must be made taking into account differences in both pumping and efficiency performance.

The "baseline" data point (Note A in Table I) for comparison to airfoil 100 is thicker airfoil 30 with a tip pitch setting angle of 15.5°. Thicker airfoil 30 was also tested at an 18° tip pitch setting angle (Note B in Table I)—although the airfoil pitch angle twist distribution across the blade span from tip to hub was unchanged from the baseline design. The setting angle of the entire blade section was adjusted. This test condition is included to show the performance of thicker airfoil 30 at a higher pumping regime.

Fan assembly 10 having airfoils 100 was tested at a blade tip pitch setting angle (of 15.5°) identical to the baseline test (Note C in Table I). This test condition shows the impact of airfoil 100 when compared to thicker airfoil 30. This test condition also matches the pumping of thicker airfoil 30 at the higher (18°) pitch angle. Finally, fan assembly 10 having airfoils 100 was tested at a blade tip pitch setting angle of 13.5° (Note D in Table I). This test condition delivers equivalent airflow performance to thicker airfoil 30 but at a reduced pitch angle.

TABLE I

Fan Assembly Performance Summary for Typical Idle Operating Conditions

| | Base | Equal Airflow Performance | | | Equal Speed Performance | | | |
|---|---|---|---|---|---|---|---|---|
| Airfoil | Std. | Std. | Lt. Wt. | Lt. Wt. | Std. | Lt. Wt. | Lt. Wt. | Type |
| Pitch | 15.5° | 18.0° | 15.5° | 13.5° | 18.0° | 15.5° | 13.5° | Degree |
| Note | A | B | C | D | B | C | D | |
| Speed | 2000 | 1917 | 1920 | 1974 | 2000 | 2000 | 2000 | RPM |
| Airflow | 24.6 | 24.6 | 24.6 | 24.6 | 25.7 | 25.6 | 24.9 | Cmm |
| Eta | 46.0% | 44.9% | 46.0% | 47.3% | 44.9% | 46.0% | 47.3% | Percent |
| Power | 109.8 | 112.4 | 109.8 | 107.6 | 127.7 | 124.1 | 111.4 | Watts |

The performance information listed below in Table I provides data for both airfoil 100 (the light weight or "Lt. Wt." airfoil) and thicker airfoil 30 (the standard or "Std." airfoil) at different tip pitch setting angles. The tests were conducted at room temperature and performance data correspond to an operating point of 1.4 (non-dimensional)—which represents a vehicle idle condition.

The data provided above in Table I show that airfoil 100, tested at the same pitch (15.5°) as thicker airfoil 30, has the same efficiency (46.0%) and airflow performance (24.6 Cmm) ("Cmm" represents cubic meters per minute) but better pumping (1920 versus 2000 RPM). The pumping of fan assembly 10 with thicker airfoil 30 at 18° essentially matches (about 1920 RPM) that with airfoil 100 at 15.5°, but has lower efficiency (44.9% versus 46.0%). Thus, ring 14 of fan assembly 10 has a lower axial depth with airfoil 100 than with thicker airfoil 30 at similar pumping. Finally, airfoil 100 at a 13.5° pitch and with a ring 14 of lower axial depth delivers superior efficiency and pumping performance compared to thicker airfoil 30 at a 15.5° pitch.

Figure 10:
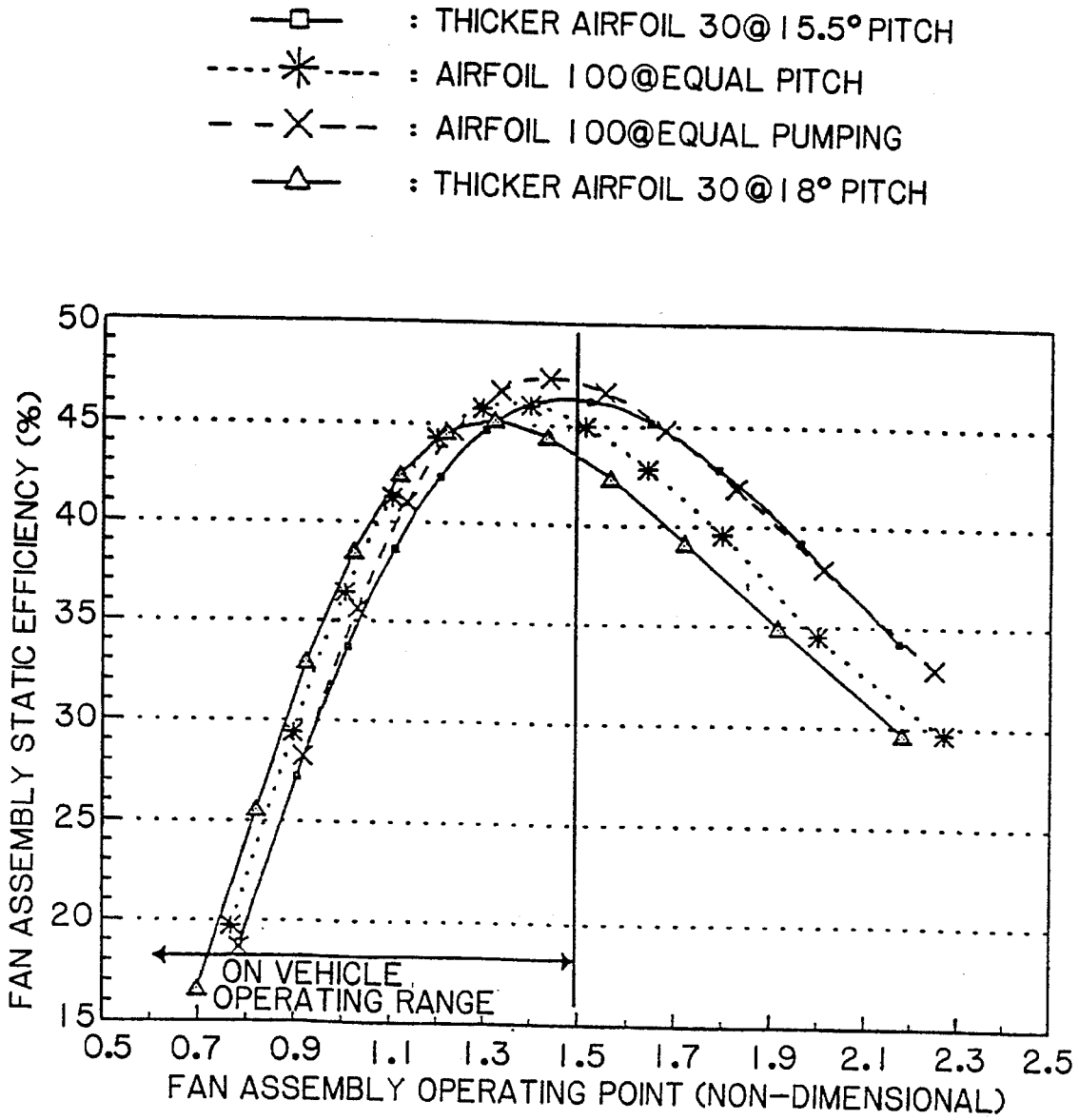
FIG. 10 is a graph of fan assembly static efficiency versus fan assembly operating point, comparing the airfoil of the present invention, shown in FIG. 6, with the conventional thicker airfoil, shown in FIG. 3*a;*

FIG. 10 is a graph of fan assembly static efficiency versus fan assembly operating point. The typical operating range of 0.7 to 1.5 for automotive cooling fan assemblies is indicated on the graph. The area of primary interest is in the operating range from 1.3 to 1.5, which represents idle operation. Four curves are provided, one each for thicker airfoil 30 at a pitch of 15.5°, airfoil 100 at an equal pitch of 15.5°, airfoil 100 which matches the pumping of thicker airfoil 30 at a pitch of 15.5°, and thicker airfoil 30 at a higher pitch of 18°. Inspection of the graph in FIG. 10 shows the improved efficiency within the idle range of interest for airfoil 100 when compared to standard, thicker airfoil 30 with equal pumping.

In summary, the fan assembly performance test results provided above evidence increased pumping using airfoil 100 of the present invention without significant loss in fan assembly efficiency. The increased pumping is due to the higher lift provided by airfoil 100. A substantially equivalent efficiency performance combined with increased pumping indicates that lift has increased in greater proportion to drag. In other words, airfoil 100 provides a higher lift-to-drag ratio than conventional, thicker airfoil 30.

Figure 4A:
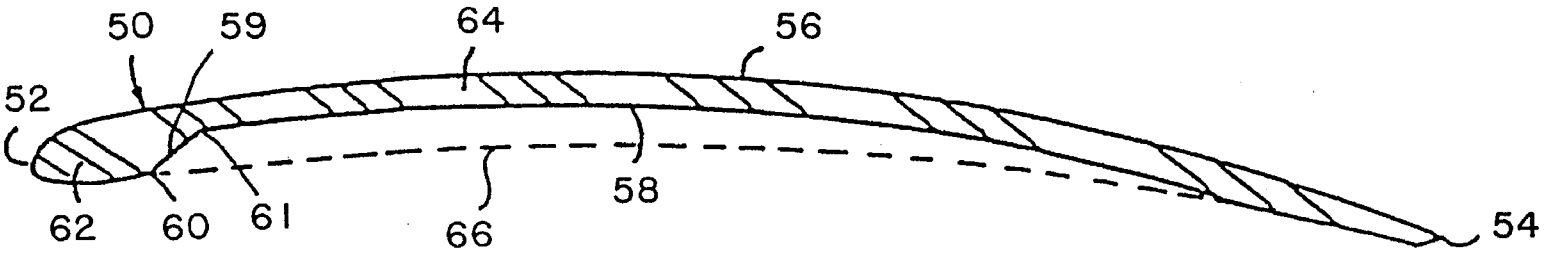
FIG.4a (PRIOR ART)
FIG. 4*a* is a cross-sectional view of a prior art ARMC airfoil.
Figure 4B:
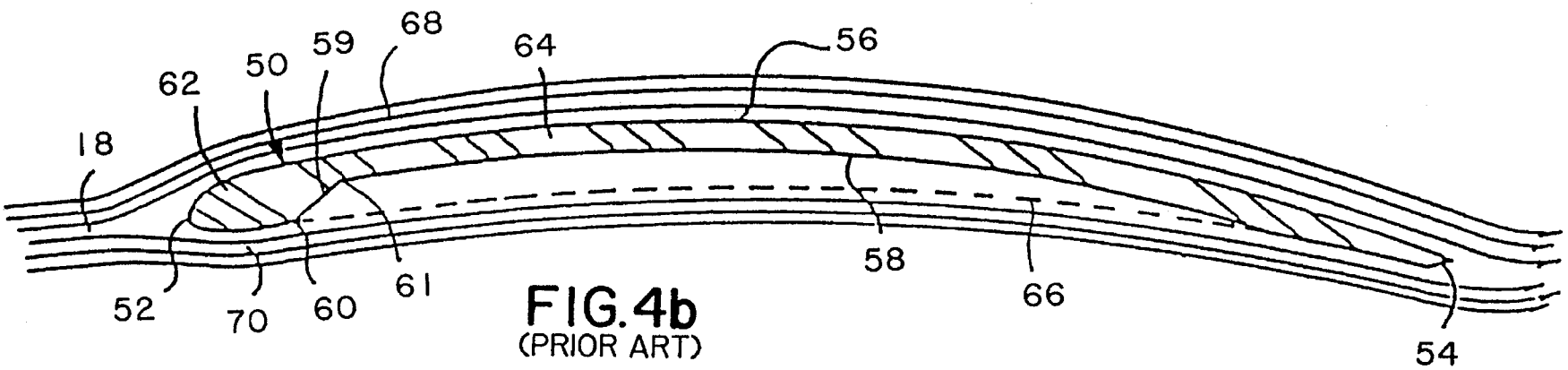
FIG.4b (PRIOR ART)
FIG. 4*b* illustrates the ARMC airfoil, shown in FIG. 4*a*, in an airstream.
Figure 11:
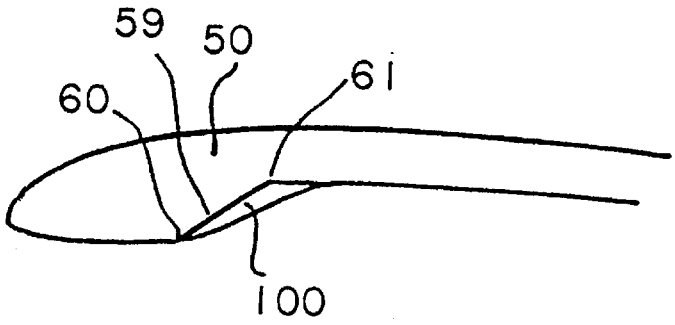
FIG. 11 is an overlay of the prior art ARMC airfoil, shown in FIG. 4*a,* on the airfoil of the present invention, shown in FIG. 6.

Turning to a comparison between airfoil 100 according to the present invention and ARMC airfoil 50, FIG. 11 highlights the difference in profile between the two airfoils. FIG. 11 is an overlay of ARMC airfoil 50 on airfoil 100. ARMC airfoil 50, with its sharp corners 60 and 61 defining straight line portion 59 on pressure surface 58 (see FIG. 4*a*), seeks to duplicate the flow over thicker airfoil 30. In contrast, airfoil 100 assures attached air flow on pressure surface 104 by a smooth blend between rounded, thick, bulbous nose section 110 and thin, highly-cambered aft section 112 (see FIG. 6). Because airfoil 100 maintains attached flow in this region of pressure surface 104, the designer can take advantage of the increased camber of airfoil 100, which, as mentioned earlier, produces increased lift.

Figure 4C:
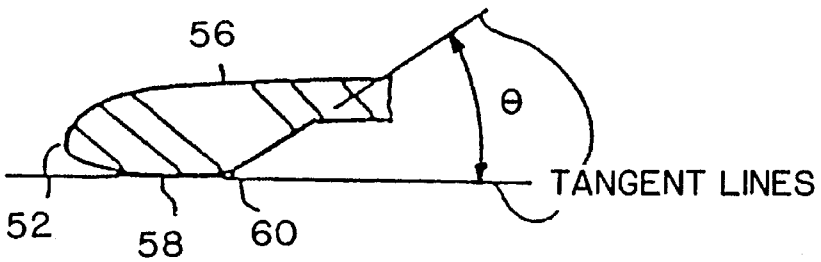
FIG.4c (PRIOR ART)
FIG. 4*c* is an enlarged view of a section of the ARMC airfoil shown in FIG. 4*a;*
Figure 12:
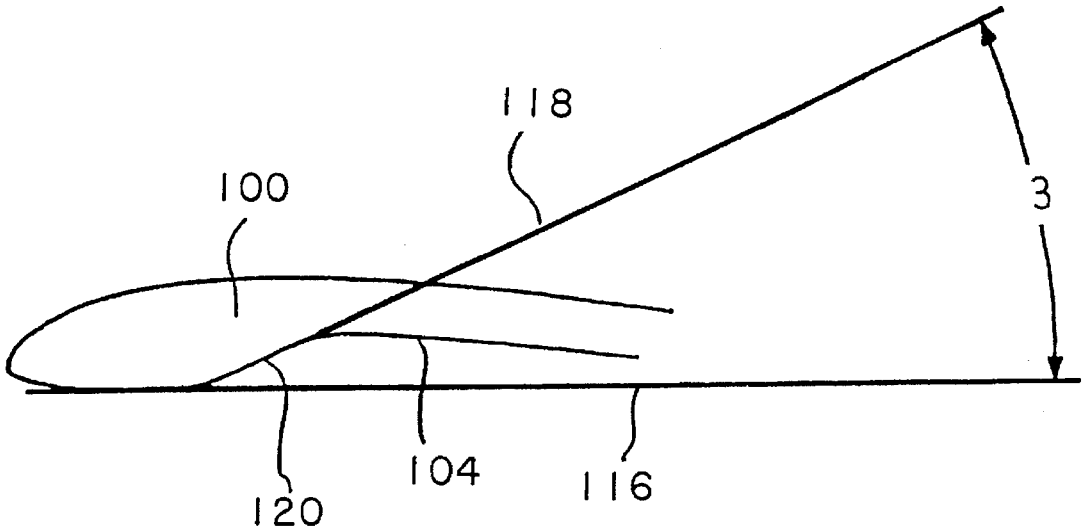
FIG. 12 is an enlarged view of a section of the airfoil of the present invention shown in FIG. 6.

Referring to FIG. 4*c*, first sharp corner 60 bends at an angle θ of at least 30°. In FIG. 12, airfoil 100 is shown with a first line 116 tangent to nose section 110 on pressure surface 104 and a second line 118 tangent to the mid-point of the gradual (not sharp) transition region 120. The resulting angle, β, between tangent lines 116 and 118 is only 24.1°—significantly less than the 30° angle of ARMC airfoil 50. Although it may vary as a function of chord, camber, and other characteristics of different airfoils, the angle β is between 20° and 28°.

Figure 5:
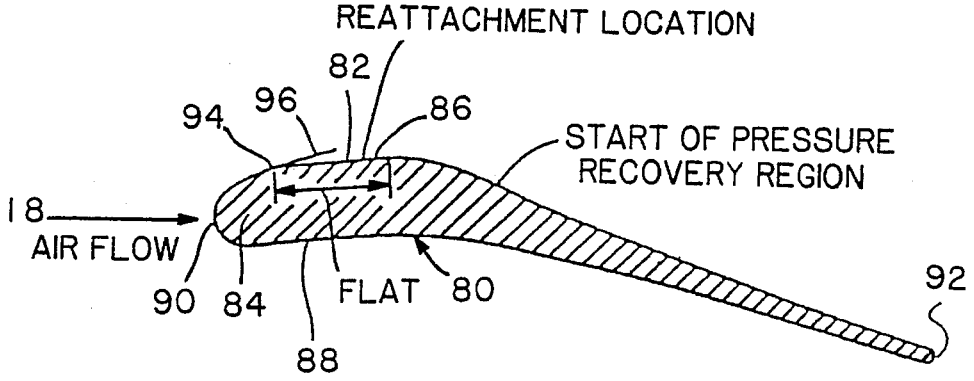
FIG. 5 (PRIOR ART)
FIG. 5 is a cross-sectional view of a conventional discontinuous airfoil.
Figure 13:
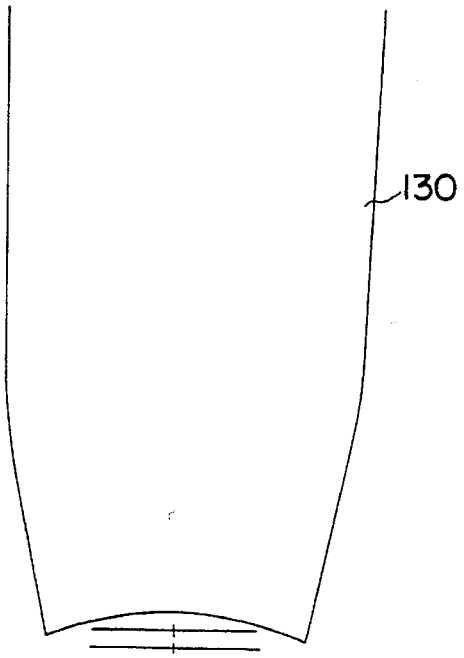
FIG. 13 illustrates a blade with a straight planform.

Discontinuous airfoil 80 with a flat 82 (see FIG. 5) provides excellent performance across a wide operating range as a blade with a straight planform. FIG. 13 illustrates a blade with a straight planform 130. Environmental concerns have prompted, however, replacement of the chlorinated fluorocarbon-containing refrigerants (such as R12) used in automotive air conditioning systems with non-CFC-containing refrigerants (such as R134a). The non-CFC refrigerants are less effective than the refrigerants they replace and require increased fan assembly airflow rates to provide performance equivalent to the CFC-containing refrigerants.

Figure 14A:
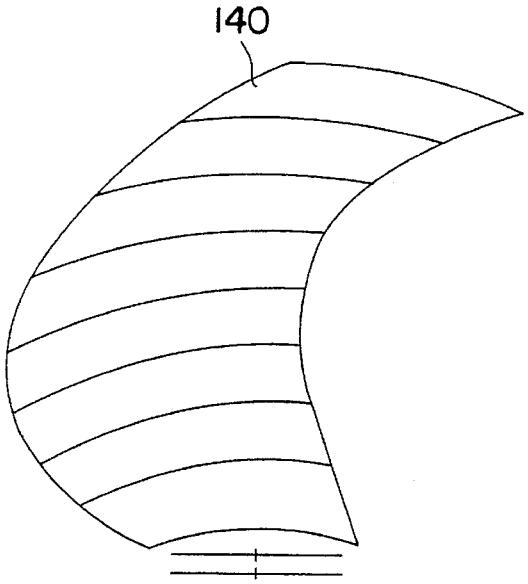
FIG. 14*a* illustrates a blade with a highly-curved blade planform.

If the existing, straight-bladed fan assemblies were used in the non-CFC-containing air conditioning systems, the assemblies would have to operate at higher speeds—thus causing increased airborne noise. Therefore, a highly-curved blade planform 140 has been used, as shown in FIG. 14*a*, to provide the air-moving performance required by the new air conditioning systems with acceptably low noise levels. On the new, backward-curved blades used in the air conditioning systems without CFCs, however, discontinuous airfoil 80 is not as effective as airfoil 100 with a smooth, continuous suction surface.

Other aspects of vehicle design, besides the switch to non-CFC-containing air conditioning systems, have prompted the use of high-pumping, high-efficiency blades with planform 140. These aspects include styling (with closed front ends, smaller grilles, and the like) that increases the system restriction, the need for increased electrical efficiency which requires more efficient fan assemblies, reduced packaging space, reduced noise, and reduced mass. Airfoil 100 with highly-curved blade planform 140 addresses all of these design aspects.

Figure 14B:
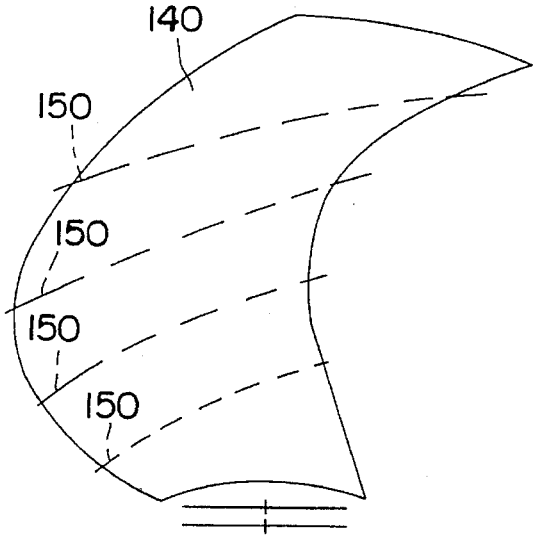
FIG. 14*b* shows the streamlines of the complex, three-dimensional flowfield over the highly-curved blade planform illustrated in FIG. 14*a.*

The highly-curved blade planform 140 produces a complex, three-dimensional flowfield 150 over the blade surface. The streamlines of such a flowfield 150 are illustrated in FIG. 14*b*. The resulting streamlines do not traverse the blade along a constant radius; rather, the streamlines tend to increase in radius from the fan inlet to exit. This radial movement of the flow makes it difficult to design a low-Reynolds-number airfoil such as discontinuous airfoil 80. The radial shifting of the streamlines, shown in FIG. 14*b*, results in an effective airfoil that is quite different from one designed for a constant-radius airflow.

In contrast, airfoil 100 of the present invention with highly-curved blade planform 140 has been successfully tested. The successful operation of airfoil 100 on the backward-curved blade is achieved by the following design features: a generous leading edge radius (which allows the flow to remain attached to suction surface 102 over a range of incidence angles) and high camber (which provides increased lift and pumping). The sculpted pressure surface 104 maintains the positive performance achieved by these design features, while at the same time reducing fan assembly mass and cost. Thus, unlike discontinuous airfoil 80, airfoil 100 is suitable for blades with swept or straight planforms.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. The engine-cooling fan assembly in which the airfoil of the present invention is incorporated, for example, may be powered by a fan clutch, an electric motor, or an hydraulic motor and may be used with or without an attached rotating ring.

What is claimed is:

1. An airfoil defining the shape of the blades of a vehicle engine-cooling fan assembly and comprising:

an unpointed leading edge;

a rounded bulbous nose section adjacent said leading edge;

a trailing edge;

a continuously curved pressure surface extending smoothly, without discontinuity, and without a planar portion from said nose section to said trailing edge;

a continuously curved suction surface extending smoothly and without discontinuity from said nose section to said trailing edge; and a thin, highly cambered aft section formed adjacent said trailing edge and between said pressure surface and said suction surface, said aft section having a location of maximum camber;

said nose section having a thickness which is greater than the thickness of said airfoil between said pressure surface and said suction surface and said nose section blending smoothly into said pressure surface via a first blend radius and a second blend radius approximately equal to said first blend radius and into said suction surface, said first blend radius forming a convex surface extending from said nose section adjacent said leading edge and said second radius forming a concave surface extending from said convex surface to said pressure surface of said airfoil.

2. The airfoil according to claim 1 wherein said airfoil has a chord and said blend radii are no less than about 8% of said chord.

3. The airfoil according to claim 2 wherein said blend radii form a gradual transition region between said nose section and said pressure surface of said airfoil.

4. The airfoil according to claim 3 wherein said gradual transition region has a midpoint and the angle formed between the tangent to said nose section adjacent said pressure surface and the tangent to said midpoint of said gradual transition region is between 20° and 28°.

5. The airfoil according to claim 1 wherein the blades having said airfoil have a straight planform.

6. The airfoil according to claim 1 wherein the blades having said airfoil have a highly-curved planform.

7. The airfoil according to claim 1 wherein said airfoil has a chord and said camber at said location of maximum camber of said aft section is between 5 and 12% of said chord.

8. An airfoil defining the shape of the blades of a vehicle engine-cooling fan assembly, having a chord, and comprising:

an unpointed leading edge;

a rounded, bulbous nose section adjacent said leading edge;

a trailing edge;

a continuously curved pressure surface extending smoothly, without discontinuity, and without a planar portion from said nose section to said trailing edge;

a continuously curved suction surface extending smoothly and without discontinuity from said nose section to said trailing edge; and a thin aft section formed adjacent said trailing edge and between said pressure surface and said suction surface, said aft section having a location of maximum camber and a camber at said location of between 5 and 12% of said chord of said airfoil;

said nose section having a thickness which is approximately twice as great as the thickness of said aft section, blending smoothly into said suction surface, and blending smoothly into said pressure surface via a first blend radius forming a convex surface extending from said nose section adjacent said leading edge and a second blend radius forming a concave surface extending from said convex surface to said pressure surface of said airfoil, said blend radii being approximately equal.

9. The airfoil according to claim 8 wherein said blend radii are no less than about 8% of said chord.

10. The airfoil according to claim 9 wherein said blend radii form a gradual transition region between said nose section and said pressure surface of said airfoil, said gradual transition region having a midpoint and the angle formed between the tangent to said nose section adjacent said pressure surface and the tangent to said midpoint of said gradual transition region is between 20° and 28°.

11. The airfoil according to claim 8 wherein the blades having said airfoil have a straight planform.

12. The airfoil according to claim 8 wherein the blades having said airfoil have a highly-curved planform.

13. A vehicle fan assembly for circulating air to cool an engine, said fan assembly comprising:

a central hub; and a plurality of blades with an airfoil and extending generally radially outward from said hub, each said airfoil having:

(a) an unpointed leading edge;

(b) a rounded, bulbous nose section adjacent said leading edge;

(c) a trailing edge;

(d) a continuously curved pressure surface extending smoothly, without discontinuity, and without a planar portion from said nose section to said trailing edge;

(e) a continuously curved suction surface extending smoothly and without discontinuity from said nose section to said trailing edge; and (f) a thin, highly cambered aft section formed adjacent said trailing edge and between said pressure surface and said suction surface;

said nose section having a thickness which is greater than the thickness of said airfoil between said pressure surface and said suction surface and said nose section blending smoothly into said pressure surface via a first blend radius and a second blend radius approximately equal to said first blend radius and into said suction surface, said first blend radius forming a convex surface extending from said nose section adjacent said leading edge and said second radius forming a concave surface extending from said convex surface to said pressure surface of said airfoil.

14. The vehicle fan assembly according to claim 13 further comprising an outer ring, said blades extending generally radially outward from said hub to said ring.

15. The vehicle fan assembly according to claim 14 wherein said ring has an axial depth of about 23 mm.

16. The vehicle fan assembly according to claim 13 wherein said blades have a straight planform.

17. The vehicle fan assembly according to claim 13 wherein said blades have a highly-curved planform.

* * * * *